US008176830B1

(12) United States Patent
Tan

(10) Patent No.: US 8,176,830 B1
(45) Date of Patent: May 15, 2012

(54) BALLISTIC SHIELD

(75) Inventor: Seng Tan, Beavercreek, OH (US)

(73) Assignee: Wright Materials Research Co., Beavercreek, OH (US)

( * ) Notice: Subject to any disclaimer, the term of this patent is extended or adjusted under 35 U.S.C. 154(b) by 254 days.

(21) Appl. No.: 12/589,298

(22) Filed: Oct. 21, 2009

Related U.S. Application Data

(63) Continuation-in-part of application No. 12/586,568, filed on Sep. 24, 2009.

(51) Int. Cl.
*F41H 5/02* (2006.01)

(52) U.S. Cl. ..... 89/36.02; 89/908; 89/917

(58) Field of Classification Search ..... 89/36.01–36.17, 89/901, 903, 904, 906, 908, 914, 915
See application file for complete search history.

(56) References Cited

U.S. PATENT DOCUMENTS 5,039,567 A * 8/1991 Landi et al. ..... 428/116
5,970,843 A * 10/1999 Strasser et al. ..... 89/36.02
6,314,858 B1 * 11/2001 Strasser et al. ..... 89/36.02
6,327,954 B1 * 12/2001 Medlin ..... 89/36.08
6,895,851 B1 * 5/2005 Adams et al. ..... 89/36.02
2010/0043630 A1 * 2/2010 Sayre et al. ..... 89/36.02
2011/0023697 A1 * 2/2011 Howland ..... 89/36.02
2011/0214560 A1 * 9/2011 Skertchly ..... 89/36.02

* cited by examiner

*Primary Examiner* — Michael Carone
*Assistant Examiner* — Samir Abdosh

(57) ABSTRACT

A ballistic shield for protection against up to 7.62×63 mm AP rounds (NIJ Level IV). The ballistic shield is multiple layered and includes polymer foam, ceramic tiles, and a support structure fabricated from ballistic resistant fabric. Individual layers are bonded with adhesives and preferably wrapped with fabric. Under the fabric cover of the exterior surface of the shield is a polymer foam layer that exhibits excellent blast impact resistance and blast attenuation properties as well as a hard ceramic or the like layer. The foam layer is preferably made from liquid crystal or semi-crystalline polymer to enhance fire resistance and provide enhanced ductility. According to various preferred embodiments, the man-portable ballistic shield also incorporates a compact video system for viewing the front side of the ballistic shield to eliminate the transparent view port of current ballistic shields and protective foam about the periphery and on the rear surface thereof.

6 Claims, 4 Drawing Sheets

BALLISTIC SHIELD

The application is a continuation-in-part of U.S. patent application Ser. No. 12/586,568, filed Sep. 24, 2009

FIELD OF THE INVENTION

The present invention relates to ballistic shields and more particularly to such devices that are light enough to be readily man portable or to serve as protective inserts.

BACKGROUND OF THE INVENTION

Man portable ballistic shields are frequently used by SWAT teams, bomb squads, policemen, military agencies, and in civilian applications that may involve fragment impact due to operations related gun fire or explosions. Weight is a major consideration in the design of such portable shields. Most currently available ballistic shields are designed to defeat NIJ Level II and III rounds. Currently available ballistic shields for NIJ Level IV (7.62×63 mm AP (Armor Piercing)) protection are so heavy that they are mounted on wheels for mobility. In recent years, the availability of higher powered rifles and a variety of small caliber AP rounds has posed additional threats for law enforcement officers as well as the military. Thus, the need for ballistic shields providing NIJ Level IV protection has significantly increased. There is an even more pressing for the military because of the greatly increased availability of 7.62×63 mm AP weapons/rounds. This invention relates to the design and manufacturing of portable ballistic shields for weapons up to 7.62×63 mm protection. These new shields are much lighter in weight than the state-of-the-art shields. They also have some fire and blast protection capabilities.

Conventional portable shields are manufactured from metal sheets including but not limited to titanium, stainless steel, carbon steel, and superalloys. More modern ballistic shields are manufactured form ballistic resistant fabrics like aramid fibers and ceramic tiles.

Man-portable shields have been used since ancient times. Our ancestors used shields to protect from stone attacks. Later, shields were used for protection from arrows attack, swords, axes, spears, and other traditional weapons. Ballistic shields evolved with the invention of guns. Ballistic shield research and development, and improvements therein have evolved in parallel with the development of offensive weapons such as small arms. Man-portable ballistic shields for NIJ Level III protection appeared when rifles were developed. A state-of-the-art ballistic shield for NIJ Level III protection with dimensions of 20.5-in by 34.5-in weighs about 32-lb (for example those available from Protech). In recent years, the availability of armor piercing rounds has significantly altered and elevated the requirements for man-portable ballistic shields. Portable ballistic shields for protection against 7.62×63 mm AP rounds were developed because of this new demand.

Thus, the increased penetrating power of small arms drove the design of the ballistic shields to be thicker and heavier. In the early stages of this development, if metals were used to manufacture shields for protection against 7.62×63 mm AP rounds a medium size shield would weigh several hundred pounds. This weight severely affected the user's mobility and were basically unmanageable. The use of ceramic tiles significantly reduced the weight of the shield. The currently available Phoenix Level IV ballistic protection shield consists of 3 pieces of ceramic tile each 16×24-in and weighs 157 pounds. Based on the same construction a shield with an overall area 21×34-in weighs about 97-lb. This state-of-the-art ballistic shield is still very heavy and therefore, is mounted on wheels or dolly for mobility. A similar evolution has occurred in the design and development of so called SAPI or small arms protective inserts for wearable body armor.

A typical ballistic man portable ballistic shield has a transparent window made of polycarbonate, see for example U.S. Pat. Nos. 7,302,880 B1 and 5,392,686. The view port is about 14.5 by 4.5-in and is fastened to the ballistic panel with screws through the front panel. Other designs use transparent polycarbonate for the entire shield, see U.S. Pat. No. 6,367,943 B1 and 5,641,934. For all these shields, a view port or an entire shield made from polycarbonate can only stop NIJ Level IIIA rounds. It is, therefore, a major weakness in the state-of-the-art NIJ Level IV ballistic shield. The shield described in U.S. Pat. No. 6,367,943 B1 uses a high-brightness light source to enhance visibility in darkness. While this improves visibility, it does not eliminate the basic problem of the relatively poor ballistic protection offered by the transparent polycarbonate window.

Thus, there remains a need for an enhanced lightweight, man portable ballistic shield that offers NIJ Level IV protection. To be considered "man portable" a ballistic shield should weigh less than about 75 pounds and preferably less than about 50 pounds. A similar need exists for lightweight SAPI elements.

OBJECTS OF THE INVENTION

It is therefore an object of the present invention to provide a lightweight man-portable ballistic shield offering NIJ Level IV protection.

It is another object of the present invention to provide such a ballistic shield that permits through shield viewing without the intentional introduction of a lower threat level weakness in the shield.

It is yet another object of the present invention to provide such a ballistic shield that permits through shield viewing in low light conditions without the intentional introduction of a lower threat level weakness in the shield.

Is yet a further object of the present invention to provide an improved, lighter weight SAPI.

SUMMARY OF THE INVENTION

According to the present invention, there are provided a relatively light weight man-portable ballistic shield for ballistic protection up to mainly 7.62×63 mm AP rounds (NIJ Level IV) and a similar SAPI element. The ballistic shield and SAPI element are multi-layered and include polymer foam, ceramic tiles, and a support structure fabricated from ballistic resistant fabrics. Individual layers are bonded with adhesives and preferably wrapped with fabric. Under the fabric cover is a polymer foam layer that exhibits excellent blast impact resistance and blast attenuation properties. Although this foam layer can be manufactured from many kinds of polymers it is preferably made from liquid crystal or semi-crystalline polymer to enhance fire resistance and provide enhanced ductility. According to a preferred embodiment, the man-portable ballistic shield of the present invention also incorporates a compact video system for viewing the front side of the ballistic shield thereby allowing for the elimination of the transparent view port weakness of current state of the art ballistic shields.

DETAILED DESCRIPTION

Co-pending U.S. patent application Ser. No. 10/982,215, describes a polymer foam that can be fabricated using a net-shape or near net-shape process or in a block form followed by slicing it into thin sheet. When the net-shape or near net-shape process is used, gas saturated polymer powder or thin sheet is placed inside a mold and heated to its melting point. Under the pressure of the gas, the polymer expands to fill the mold and quickly becomes a net-shape foamed layer. Processing of a block foam is described in U.S. Pat. No. 6,232,354 B1. In this embodiment, the polymer powder or sheets are heated under pressure to form a consolidated panel. The consolidated panel is then foamed in a pressure vessel. An inert gas such as nitrogen or carbon dioxide is used as the foaming agent. After saturating the consolidated panel is pressurized with an inert fluid at an elevated temperature for a short period of time. Saturation with the inert fluid can be accomplished within 10 minutes to a few hours at elevated temperatures depending on the thickness of the part. The saturating fluid is then released quickly to ambient pressure. It is then controllably cooled down. This process creates micron size bubbles in the consolidated panel polymer matrix. No chemicals or solvents are needed for the foaming process. In the case of two-step process described in the foregoing U.S. patent, the foam matrix is fabricated without fabrics. It is then sliced into thin sheets. Alternatively, this polymer foam layer can be purchased from a commercially available source. The ceramic layer can be manufactured in single or multiple pieces. It should exhibit a hard value of hardness. The multi-layered fabric of the support structure should have good ballistic resistant properties such as those demonstrated by aramid fabrics.

The second major component of the preferred ballistic shield of the present invention is a lightweight and compact video system that eliminates the transparent view port of current state of the art shields. The video system preferably comprises an LCD and a compact camera. The camera enables the user to see the other/front side of the shield in daytime and in darkness. The power source is a compact battery installed in the video enclosure.

The main objective of the instant invention is to provide a family of lightweight composite shield materials and devices for ballistic protection. The ballistic shield and SAPI of the present invention with an areal density of about 7 psf (pound-per-square-foot) and weight of the ballistic shield about 44-lb (including the video system) have the capability of defeating multiple hit of ballistic impact up to the 7.62×63 mm AP (NIJ Level IV) round. Currently available similar protective devices for NIJ Level IV protection weigh about two times more. The ballistic shield according to this invention also has some fire resistant and blast protection capability.

Figure 1:
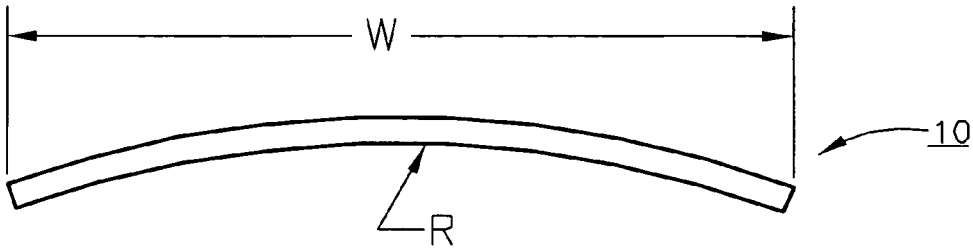
FIG. 1 is top plan view of the ballistic shield in accordance with the present invention.
Figure 2:
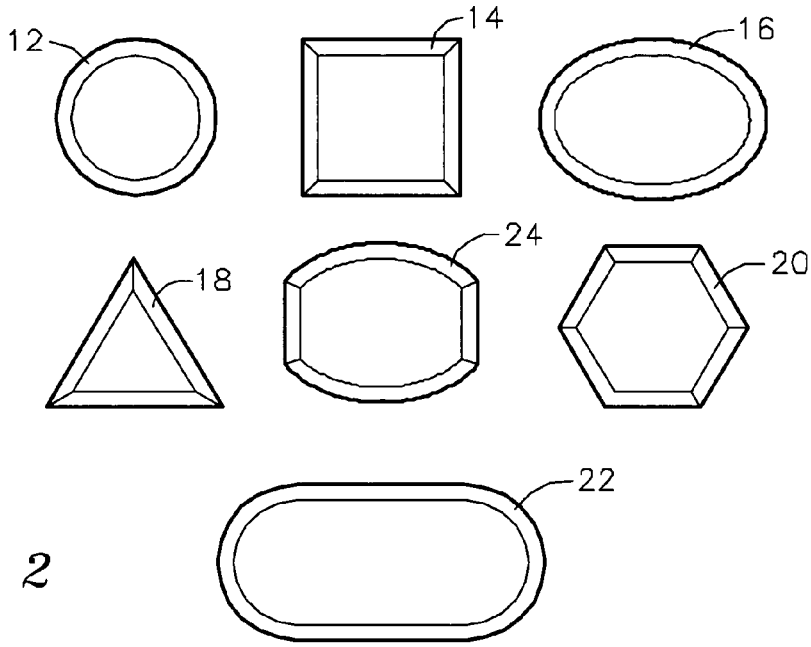
FIG. 2 shows a variety of enclosed shapes that can be used for the ballistic shield of the present invention.

Referring now to the accompanying drawings, FIG. 1 shows the top view of the ballistic shield 10 of the present invention. It has a radius of curvature R from infinity (flat plate) to a small dimension as 1-in. In the case of small radius of curvature the shield will have a tubular shape. In the case of other radii of curvature a complete structure could have a large cylindrical shape. Ballistic shields with various enclosed shapes, as shown in FIG. 2, have applications for protection of wires/cables, instruments, liquid, gases, and other important substances, structures or components. The ballistic shields with enclosed shapes may include but are not limited to circular 12, rectangular 14, elliptical 16, triangular 18, hexagonal 20, pentagonal, and any combination of different shapes like circular and straight 22 and 24 as depicted in FIG. 2.

Figure 3:
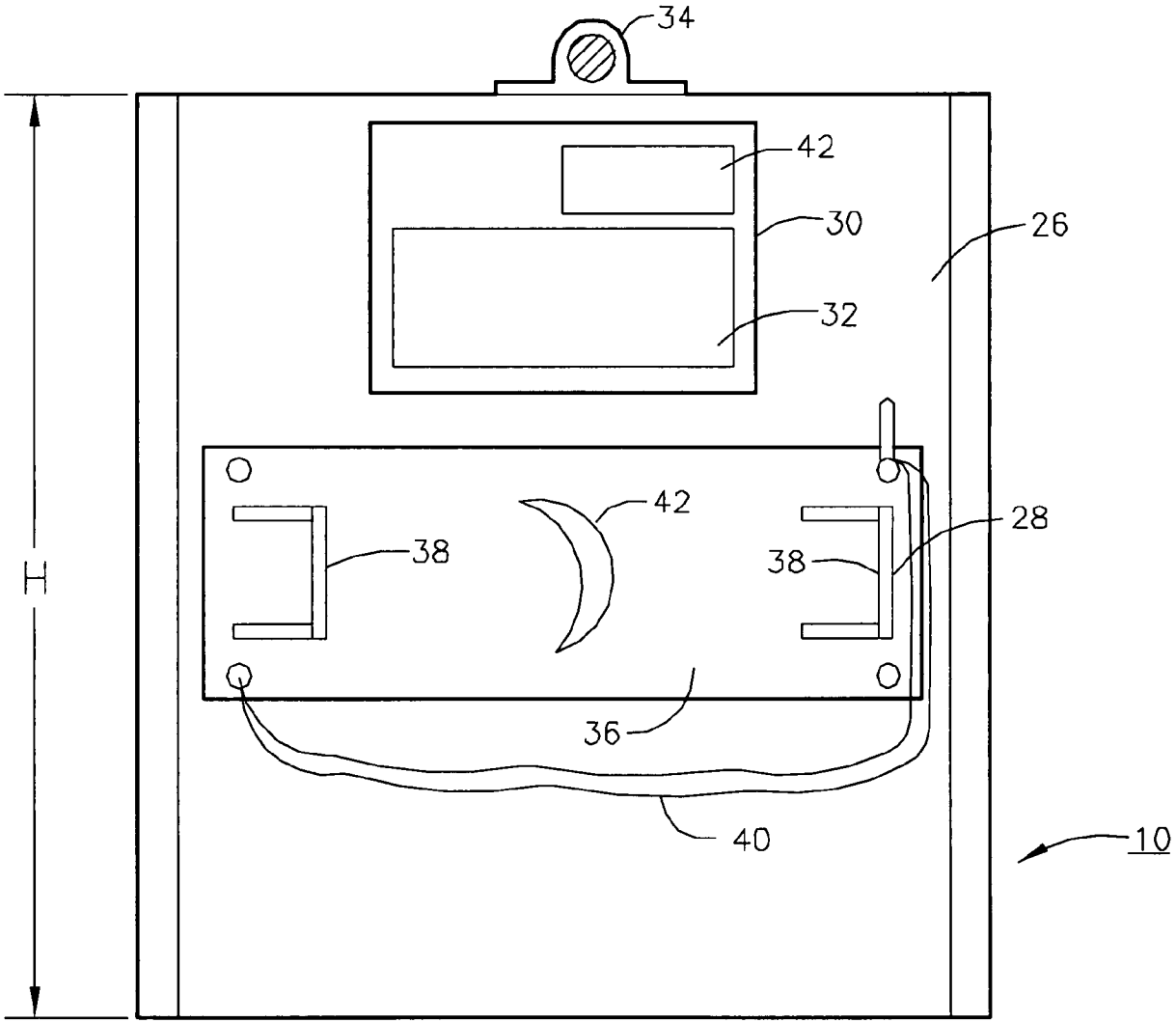
FIG. 3 is a rear view of the ballistic shield in accordance with the present invention.

In this invention, the ballistic shield for personnel protection can be manufactured in a flat shape (radius of curvature at infinity) or with a curvature. Referring again to the accompanying drawings, depicted in FIG. 1, is one preferred embodiment of the ballistic shield 10 of the present invention. W is the projected width of the shield. The radius of curvature R of ballistic shield 10 ranges from 10-in to infinity preferably between 30-in to infinity. A rear view of ballistic shield 10 is schematically shown in FIG. 3. H designates the height of ballistic shield 10. As depicted in FIG. 3, ballistic shield 10 in accordance with the present invention comprises a main body 26 made up of a metal sheet 28, an enclosure 30 for video display system 32, and a compact camera 34. A shield carrying plate (lightweight metal or plastic) 36 contains two handles 38 for right-handed and left-handed users. It also includes a shoulder strap 40 and forearm strap 42. The video system consists of an enclosure 30, a liquid crystal display (LCD) or similar viewing system 32, and a battery 42. Enclosure 30 can be made of a lightweight metal including, but not limited, to aluminum or a plastic sheet including, but not limited, to polycarbonate. A sheet of metal or plastic can be cut using a pattern and folded to become the enclosure. It can be attached to the main body 26 using hooks, adhesives, screws, or Velcro®.

Figure 4:
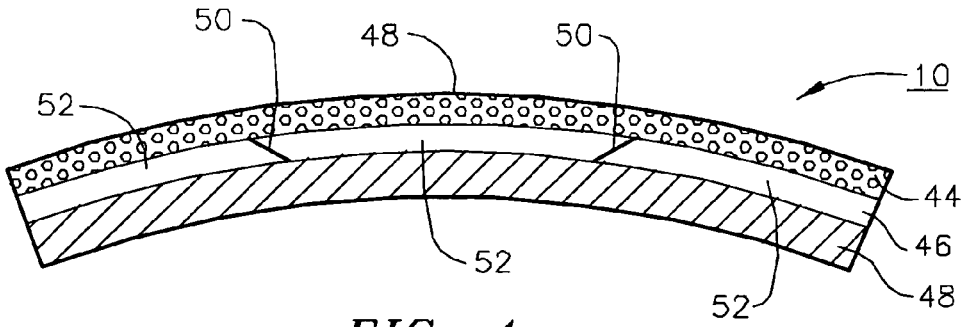
FIG. 4 is a schematic cross-sectional view of the ballistic shield in accordance with the present invention.

FIG. 4 depicts a cross sectional view of shield 10 as shown in FIG. 1. As shown in FIG. 4, ballistic shield 10 is of a multi-layered design. The outer layer 44 is a polymer foam. Underneath polymer foam layer 44 is a layer 46 of ceramic tiles. Ceramic tile layer 46 is supported by a composite structure 48 made from ballistic resistant fabrics. Ceramic layer 46 may comprise one or multiple pieces. A multiple-piece design can enhance the multiple hit capability of ballistic shield 10. The contact angle between adjacent ceramic plates (52 in FIG. 4) can be 90-degree or at a slanted angle. Since firearm attacks are most likely to approach from the front 48 of ballistic shield 10, it is better to design the contact angle in an off-axis angle, as shown at 50 in FIG. 4. The off-axis angle (from the plane direction) can range from 10 to 90-degree preferably from 30 to 90-degree. Laboratory tests of angular orientations indicate the reduction or elimination of the weakness of conventional joints that use a 90-degree of contact angle. A rifle bullet can penetrate the 90-degree joint but is stopped by the present design of off-axis contact angle.

Although the polymer foam can be manufactured from any suitable commercially available polymer, it is preferable to use from those that have excellent fracture toughness and fire retardant properties including but not limited to polycarbonate, liquid crystalline polymer (LCP), polyurethanes (PU), polyisocyanurate (PIR), elastomers, polyetherimide (PEI, e.g., Ultem), PMMA, crystalline and semi-crystalline polymers, shape memory polymers, polyesters, epoxies, polyimides, etc. The polymer foam may be reinforced by chopped fibers, whiskers, ceramic powders, metal powders, various kinds of nano-fibers, various kinds of nano-tubes, nano-wires, particles, etc. The reinforcement may serve to enhance the impact, fire resistant, thermal insulation, or other functional properties. The foam matrix is preferably characterized by cell diameters of from about 1 micron to about 3 mm. The pores of the polymeric foam can be either closed or open cell, preferably closed-cell. As an example, the polymer foam can be manufactured using the net-shape or near net-shape LCP foam described in the pending U.S. patent application Ser. Nos. 11/807,488 and 12/284,564. It can also be sliced from the LCP foam block prepared as described in U.S. Pat. No. 6,232,354 B1. Since the polymer foams layer are very ductile they can enhance the blast resistance properties of the ballistic shield. It can also prevent the ceramic layer 22 from damage due to handling, operations or fragment attack.

Ceramic plates 52 making up ceramic layer 46 can be chosen from a variety of ceramic plates exhibiting hardnesses over 1000 kg/mm$^2$. The thickness of the ceramic layer should be above 0.1-in. It can be manufactured in one or multiple pieces. In the case of a multiple-piece design shown in FIG. 4, the joining edges can be cut in 90-degree or a slanted angle. Alternatively, the ceramic layer may be replaced by a light-weight material with the same or higher value of hardness. These may include intermetallic, composites of metals and ceramics, nanocomposites, etc. The main purpose of this hard layer is to blunt the pointed tip of an incoming round or fragment. The support structure will then capture or stop the blunted bullet completely.

The support structure (composite) in this invention may consist of multiple layers of para-aramid fabrics like Kevlar®/Twaron®, ultra high molecular weight polyethylene (2,000,000 or more in molecular weight) fabrics like Spectra® and polybenzobisoxazole (PBO) fabrics. The number of layers of fabric used depends on the kind and thickness of the fabric as well as the threat to be overcome. It should preferably be between 10 and 100 layers. An appropriate design should be balance the properties of the ceramic tile and the support structure. For example, a thicker ceramic tile may use a thinner support structure. On the other hand, a thinner ceramic tile should use a thicker support structure. An appropriate ratio will achieve an optimal design of weight and ballistic resistant properties.

The polymer foam can be bonded to the ceramic layer by any adhesives including but not limited to 3M sprayed adhesive, elastomers, RTV, polyurethanes, epoxies, polyesters, shoe-goo, etc. These adhesives can also be used to bond the ceramic layer and the support structure.

The ballistic resistant structures of the present invention can, of course utilize other kinds of ballistic resistant fabrics, fabric with other patterns and designs, different stacking sequences, different thicknesses and number of fabric layers, variations in the hard layer (thickness, cutting angles, etc.), and foams with different densities or pore sizes. From the foregoing description and drawings, it will be apparent to the skilled artisan that many suitable arrangements of the polymer foam, layer(s) of hard material and the impact resistant fabrics for the support structure are to be considered as within the scope of the present invention.

Figure 5:
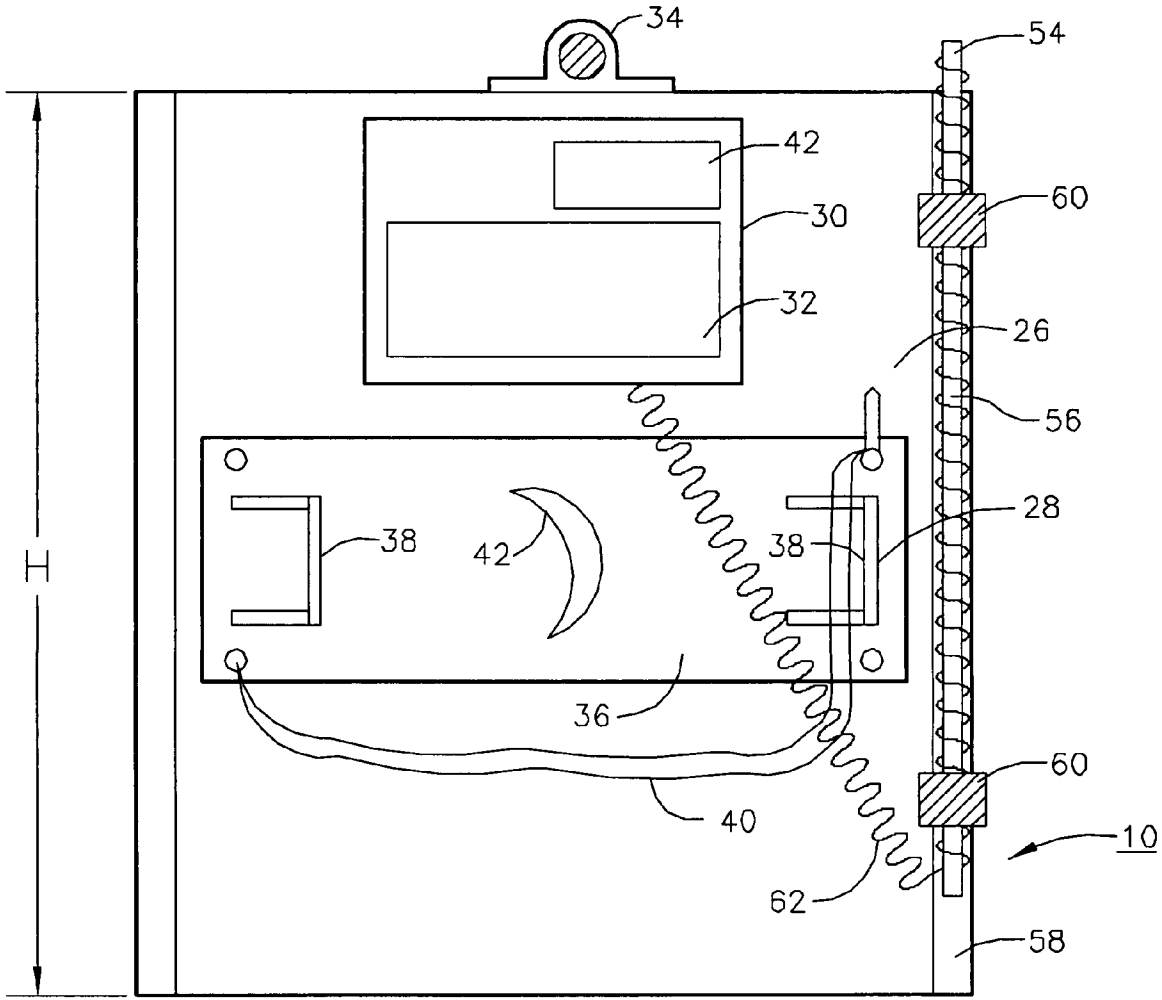
FIG. 5 is a rear view of the ballistic shield incorporating a compact camera in accordance with a preferred embodiment of the present invention.
Figure 6:
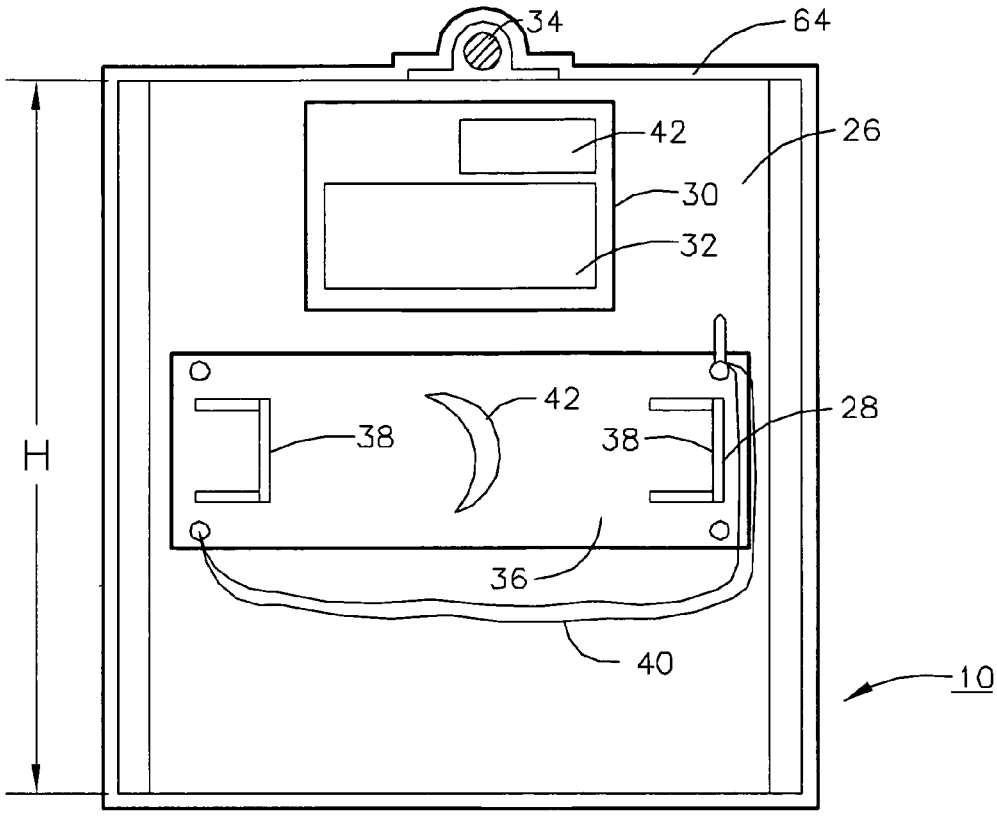
FIG. 6 is a front view of an enhanced embodiment of the ballistic device of the present invention.

The ballistic shield's viewing capability can be enhanced by using high resolution liquid crystal displays (LCDs) or similar viewing devices, multiple cameras, and other similar techniques. As shown in FIG. 5, we have developed a design that enables a very broad viewing area. As shown in FIG. 5, a second very compact camera 54 is attached to the end of a lightweight telescoping rod 56. In its stowed position, telescoping rod 56 is attached to the edge 58 of the shield via clips or Velcro® 60. Telescoping stick 56, in its stowed position, is preferably shorter than the height H of ballistic shield 10 for convenience of utilization. Clips or Velcro® 60 allow the user to dismount and mount telescoping rod 56, i.e. extend telescoping rod 56 forward of the front surface of ballistic shield 10, using one hand. Camera 54 is connected to the LCD or other suitable display system 52 by a coiled wire 62. Such a viewing device offers several advantages to the man-portable shield 10. It enables user to: (1) see things over tens of feet high (several story building); (2) observe activities around corners without exposure of the user's body; and (3) view activities through gaps or tiny spaces like under a door or through a window. The combination of telescoping rod 56 and compact camera 54 greatly enhances the user's viewing capability and reduces the risk of surprise attack. It also provides a secondary camera, in addition to camera 34, in case one camera is damaged. As will be apparent to the skilled artisan, cameras 34 and 54 may include infrared capabilities for viewing in low light and/or smoky conditions.

It should be understood that ballistic shield 10 may be mounted on a movable device or cart so that the user can have both hands free.

The following examples will serve to provide a better understanding of the structure and design of ballistic shield 10 in accordance with the present invention.

EXAMPLE 1

Spectra Shield® was purchased from Honeywell (101 Columbia Road, Morristown, N.J. 07962). Kevlar®, and Twaron® fabrics were purchased from Barrday, Inc. (75 Moorefield St., P.O. Box 790, Cambridge, ON N1R 5W6) and Hexcel Schwebel (2200 South Murray Ave., Anderson, S.C.). To fabricate the support structure with the single curvature as shown in FIGS. 1 and 4 we machined a closed mold from aluminum alloy. With a radius of curvature of 20-in and a projected width of 20-in the length of the curve is about 21-in. The height of the mold is 34-in. We first cut 28 layers of Spectra Shield and placed them into the mold. After closing the mold we heated the mold platens of a hydraulic press top to a temperature of between 120 and 150° C. and soaked for 10 to 60-min. The mold was then cooled down to a temperature somewhat below the molding point. The sample was removed from the mold. It has become a well-consolidated structure with a single curvature with a radius of curvature of 20-in. We repeated the molding cycle using 50 and 52 sheets of Spectra Shield® which produced well-consolidated and rigid structures. We then molded phenolic coated Twaron® fabrics and phenolic coated Kevlar® fabrics comprising between 20 and 45 sheets. All of these layered configurations produced consolidated and rigid structures.

EXAMPLE 2

A Xydar® (LCP) foam block was manufactured according to the process described in a co-pending U.S. patent application Ser. No. 11/807,488. It was sliced into thin sheets between 0.125 and 0.25-in thick.

Silicon carbide tiles were purchased from CoorsTek (600 9$^{th}$ Street, P.O. Box 4025, Golden, Colo. 80401). Three pieces of SiC tiles were manufactured to make up the sizes (20-in projected width and 34-in height) and shape (radius of curvature of 20-in) as shown in FIGS. 1 and 4.

Using a Spectra Shield® support structure molded as described in EXAMPLE 1 we bonded the SiC tiles and the support structure with a room temperature cured adhesive. It was a Loctite® 60-min cure adhesive produced by Henkel Corporation was used for bonding. After 60-min or longer of cure time the SiC tiles and the Spectra Shield support structure became an integrated structure. The thin sheet of Xydar® foam mentioned above was then bonded to this structure using a sprayed adhesive manufactured by 3M. The foam was under light pressure during the curing of the sprayed adhesive. After holding for 20-min or longer the three components became an integrated structure. It was then wrapped up using a fabric. A fabric with foliage green color was used as it is the color designated for E-SAPI with NIJ Level IV protection. The 3M sprayed adhesive was used to bond the folded edges of the fabric. This completed the manufacturing of the main body of the ballistic shield.

EXAMPLE 3

Two to eight holes were drilled along both sides of the support structure, prepared as described above, before it was bonded to the foam and ceramic plates. The holes were located near the center along the side of the shield. This allows the shield carrying plate 36 to be fastened at various locations and enable the user to conveniently cover the vital areas of his/her body according to his/her height. Tee nuts were installed at these holes. The shield carrying plate 36 is fastened to the shield using bolts through these holes with T nuts. This design does not create any holes in the hard layer and therefore eliminates all the weaknesses due to window and fastening that occur in the conventional ballistic shields.

EXAMPLE 4

LCD display enclosure 30 was manufactured from a thin, lightweight metal like aluminum alloy or plastics like polycarbonate. An aluminum alloy sheet about 0.125-in thick was cut and folded into the shape of the enclosure 30. The folded enclosure may have open sides that additional plates are needed to cover the sides through bonding or bolts. The manufacturing of the enclosure by a folding technique is only a convenient and cost-effective technique. It can be manufactured by cutting several pieces and bonding or fastening them together. The thickness of the sheet material for the construction of the enclosure can range between 0.01-in and 0.5-in. Obviously, a thinner material results in lighter weight. The dimensions of the LCD can range from 1 by 2-in to the width of the ballistic shield. It is preferably smaller than the width of the shield as a larger LCD increases the weight of the product.

EXAMPLE 5

Flammability tests were performed using ASTM E 1354v Cone calorimeter tests at a radiant heat flux of 35 KW/m$^2$. The test results, Table 1, indicate that the weight losses of black PMMA, Kevlar/Xydar® foamed composite sandwich, PBO/Xydar® foamed composite sandwich and Xydar® (LCP) foam are 100%, 30.8%, 5.9%, and 46.4%, respectively. Apparently, the LCP foam used as the outer layer of the ballistic shield in this invention is superior to black PMMA and other polymer systems tested by FAA. During the entire test, the following properties were recorded and plotted: HRR (heat release rate per unit area), SPR (smoke production rate per unit area of exposed specimen), mass lost, $t_{ig}$ (time to ignition and sustained flaming over specimen surface for at least 10 sec), and $t_b$ (total burning duration–ignition to mass loss less than 150 g/m$^2$).

TABLE 1

LCP foam's fire resistant properties.

| Material | $t_{ig}$ (s) | $t_b$ (s) | $HRR_{peak}$ (kW/m$^2$) | $t_{peak}$ (s) | THR (MJ/m$^2$) |
|---|---|---|---|---|---|
| Black PMMA | 26 | 1154 | 715 | 880 | 727.6 |
| 0202.PB02 | 399 | 3450 | 95 | 770 | 180.3 |
| 0301.PB013 | 603 | 1574 | 29 | 1045 | 15.7 |
| 0302.LCP10 | 287 | 2052 | 84 | 305 | 78.7 |

| Material | $HRR_{60S}$ (kW/m$^2$) | $HRR_{180S}$ (kW/m$^2$) | $HRR_{300S}$ (kW/m$^2$) | $HRR_{30S,MAX}$ (kW/m$^2$) | 10-90 MLR (g/m$^2$-s) |
|---|---|---|---|---|---|
| Black PMMA | 345 | 526 | 571 | | 27.8 |
| 0202.PB02 | 7 | 33 | 48 | 94 | 2.3 |
| 0301.PB013 | 9 | 16 | 18 | 28 | 0.9 |
| 0302.LCP10 | 63 | 48 | 46 | 76 | 1.7 |

| Material | Initial Mass (g) | Final Mass (g) | Mass Loss (g) | Mass Loss (%) | EHC (MJ/kg) |
|---|---|---|---|---|---|
| Black PMMA | 307.8 | 0.2 | 307.7 | 100 | 23.7 |
| 0202.PB02 | 226.4 | 154.1 | 69.7 | 30.8 | 22.9 |
| 0301.PB013 | 198.4 | 183.1 | 11.7 | 5.9 | 11.8 |
| 0302.LCP10 | 64.7 | 33.8 | 30 | 46.4 | 23.2 |

| Material | SEA (m$^2$/kg) | SPR (1/s) | $SR_1$ (m$^2$/m$^2$) | $SR_2$ (m$^2$/m$^2$) | TSR (m$^2$/m$^2$) |
|---|---|---|---|---|---|
| Black PMMA | 90 | | | | |
| 0202.PB02 | 189 | 0.41 | 98 | 1493 | 1591 |
| 0301.PB013 | 54 | 0.08 | 110 | 72 | 182 |
| 0302.LCP10 | 127 | 0.22 | 96 | 430 | 525 |

0202.PBO2: Kevlar ®/Xydar ® foamed composite sandwich
0301.PBO13: PBO/Xydar ® foamed composite sandwich
0302.LCP10: Xydar ® (LCP) foam

EXAMPLE 6

We manufactured a ballistic shield with dimensions of 20-in wide (21-in measured along the curvature) by 34-in height according to the procedures and materials mentioned above. The LCP foam layer was manufactured from Xydar® based on the technique disclosed in a co-pending U.S. patent application Ser. No. 11/807,488 SiC plates were purchased from CoorsTek as a special custom made item. The edges of the SiC plates have a 45-degree bevel as shown in FIG. 4. Three SiC plates were used to make the ballistic shield that has a radius of curvature of 20-in. A support structure was molded from Spectra Shield® according to EXAMPLE 1. These components were bonded using 3M sprayed adhesive and 60-min cured Loctite® adhesive. The thus formed composite was then wrapped with a foliage green color fabric and bonded with a sprayed adhesive. The completed shield weighed 44-lb. The ballistic shield was tested by ICS Laboratories Inc. (1072 Industrial Parkway North, Brunswick, Ohio 44212) based on the standard NIJ 0108.01. It was tested with 7.62×63 mm AP M2 (NIJ Level IV) rounds at an average of 2880 fps (feet per second). ICS certified that the thus produced shield had a multiple hit capability of up to 3 shoots. Three more ballistic shields were subsequently manufactured and shipped to ICS to determine the V50 of this model using 7.62×63 mm AP M2 (NIJ Level IV) rounds. ICS determined that the V50 of this model was 3095 fps.

EXAMPLE 7

A ballistic shield was manufactured using 53 layers of Twaron® fabrics and a thin layer of Xydar® foam. It has an areal density of about 7 psf. A ballistic shield manufactured according to this example demonstrated that it can defeat multiple hits of AK47 FMJ delivered at 2400 fps. When a thin layer of SiC plate was used, the number of layers of the Twaron® fabrics. The shield had an areal density of about 6.9 psf. It can defeat multiple hit of AK47 FMJ delivered at 2400 fps.

EXAMPLE 8

A ballistic shield was molded from Spectra Shield® support structure was prepared as described above and bonded to a Xydar® foam at the exterior surface. It was then wrapped with a fabric of foliage green color. This shield has dimensions of 21 (along curvature) by 34-in. and weighed about 13.5-lb. Ballistic tests showed that it can defeat various kinds of hand guns, fragments, and AK47 hollow point rounds.

EXAMPLE 9

A ballistic shield was molded from Spectra Shield® and bonded to a Xydar® foam at the exterior surface. It was then wrapped with a fabric with foliage green color. This shield has dimensions of 21 (along curvature) by 34-in. and weighs about 13.5-lb. Ballistic tests showed that it can defeat various kinds of hand guns, fragments, and AK47 hollow point rounds.

This shield meets the UL752 level 7 and NIJ Level III standards. This design has potential application for firefighter and policeman for riot control. These applications may involve hand guns, small rifle like AK47, fragment impact, fire and smoke. Our infrared camera system allows user to see things in smoky and dark environments.

There have thus been described portable ballistic shields that exhibit the following capabilities:

1. ability to defeat NIJ Level IV 7.62×63 mm AP rounds in multiple hits;
2. lightweight (over 120% lighter than state-of-the-art ballistic shields);
3. different viewing options to fit customer's own needs;
4. eliminates the viewing port weaknesses of conventional man-portable protective shields;
5. enables user to see things in the dark without using a bright light;
6. fire retardant; and
7. some blast protection capability.

According to an alternative preferred embodiment of the present invention there is provided a lightweight hard armor composite, a Small Arms Protective Insert (SAPI), that possesses exceptional fragmentation resistance, multi-hit capacity, low behind-the-armor impact force, and high durability for handling. Such a modified preferred ballistic shield is shown in attached FIG. 7. According to this embodiment, ballistic shield 10 includes a first thin layer of elastomer foam 44 on the front surface thereof and a layer of resilient material such as foam 64 about the outside periphery thereof, a hard layer 46 (described in greater detail hereinabove and below), a supporting composite layer 48 comprising multiple layers of ballistic resistant fabrics, and a thin energy absorbing layer 66 of a microcellular polymer foam or elastomer to protect the user in the event of ballistic or fragment impact of SAPI 10 during and encounter. The main features of this preferred embodiment of the ballistic protective device of the present invention include lightweight, multi-hit capability, high durability for handling (e.g., if dropped onto the ground), and a significant reduction in behind-the-armor or user impact force as compared to similar state-of-the-art devices/inserts or shields during an encounter of the front surface with an obstacle or individual.

For lightweight, hard layer 46 is preferably manufactured from ceramic plates 52 including, but not limited to, SiC (silicon carbide) and $B_4C$ (boron carbide). The molds for the manufacturing of the ceramic plate and the supporting structure are designed so that the various elements are in intimate contact when they are stacked together. This is because even a tiny gap between a ceramic plate and the supporting structure can cause cracking of the ceramic plate upon impact by a bullet or other projectile due to bending moment. However, most ceramic plate materials have some deformation after sintering, and it is extremely difficult to manufacture the ballistic shield of the present invention without at least some tiny gaps between ceramic plates and the supporting structure using a single mold for multiple ceramic plates.

Thus, it is necessary to develop a manufacturing process to accomplish this objective of intimate contact between the various elements of the ballistic shield. This process comprises: wrapping a suitable ceramic plate a thin plastic sheet, fabricating a pair of molds from a blend of hydro-stone powder, water and fiber strands and pouring it over the ceramic plate using the ceramic plate as the shape of the cavity; curing the mold thus formed at slightly elevated temperature for a few hours; placing appropriately sized layers of the previously described ballistic resistant fabrics, Spectra Shield®, Kevlar®, Twaron® or the like into the mold with the ceramic plates; heating the mold between the platens of a hot press to a temperature of between about 120 and 150° C. and soaking for from about 15 to about 60 minutes; and cooling the mold down to between about 80° and about 110° C. The mold is then opened and the supporting structure removed to be placed put on the ceramic plate used to form the mold. The ceramic plate and the ballistic fabric supporting structure are then held together tightly by any mechanical means and cooled down to room temperature.

Hydro stone powder was obtained from United State Gypsum Company (125 South Franklin Street, Chicago, Ill. 60606 4678). As previously described, the supporting structure is fabricated with between 10 and 100 layers (depending on the thickness of the fabric and the level of protection needed) from ballistic resistant fabrics like Spectra Shield®, Kevlar®, Twaron® or the like fabrics and a layer of adhesive included between each of the layers of the laminate. The ceramic plate and the supporting structure are preferably bonded together using a two-part resin like Loctite resin.

According to the preferred embodiment described herein, a thin layer of elastomeric foam (preferably from about 0.1 to about 1-in, and most preferably less than about 0.5-in) is adhered to the exterior of ceramic plates 52 as layer 44.

According to the further preferred embodiment described herein, a thin layer of energy absorbing material such as PC foam, LCP or other polymer or elastomeric foam (from about 0.1 to about 1-inches in thickness and preferably less than about 0.5-inches thick) is adhered to the exterior of supporting plate 48 as energy absorbent layer 66.

Polymer foam layer 44 can be prepared from any available commercially foamable polymers, but preferably thermoplastic polymers. It is preferable to use polymers that exhibit excellent fracture toughness such as but not limited to polycarbonate, liquid crystalline polymer (LCP), polyurethanes (PU), polyisocyanurate (PIR), elastomers, polyetherimide (PEI, e.g., Ultem®), PMMA, crystalline and semi-crystalline polymers, shape memory polymers, polyesters, epoxies, polyimides, etc. The polymer foam may be reinforced by chopped fibers, whiskers, ceramic powders, metal powders, various kinds of nano-fibers, various kinds of nano-tubes, nanowires, particles, etc.

Ceramic layer 46 comprising ceramic plates 52 can be fabricated from a variety of ceramics that have high hardness values, i.e. above 1000 kg/mm$^2$ and preferably above 2000 kg/mm$^2$. The thickness of hard layer 46 should be above 0.1-in. As previously described, layer 46 can be manufactured from one or multiple plates 52. In the case of multiple-multiple plates the joining edges can be cut in 90-degree or a slanted angle between 10 and 90-degree. Yet another alternative is to use multiple pieces of thin ceramic plates. Yet another alternatively is to fabricate hard layer 46 from a lightweight material with the same or a higher value of hardness. Such materials may include intermetallic, composite of metals and ceramics, nanocomposites, etc. The main purpose of hard layer 46 is to blunt the pointed tip of an incoming bullet, fragment or other projectile. The support structure then captures or stops the blunted projectile completely.

The following additional examples will serve to further illustrate the successful practice of the preferred embodiment of the present invention described herein.

EXAMPLE 10

Figure 7:
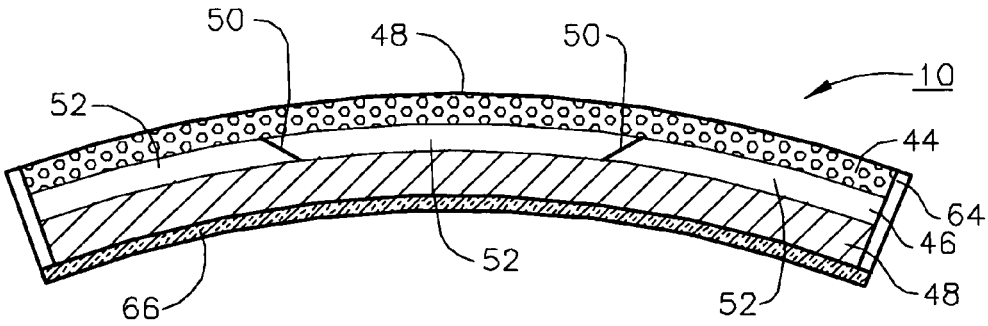
FIG. 7 is a cross-sectional view of an enhanced embodiment of the SAPI device of the present invention.

We fabricated a SAPI prototype based on design shown in FIG. 7 with a SiC plate, an elastomer foam layer near the outer surface, a backing structure consisting of 46 layers of Spectra Shield®. Spectra Shield® was purchased from Honeywell (101 Columbia Road, Morristown, N.J. 07962). Silicon carbide tiles were purchased from CoorsTek (600 9$^{th}$ Street, P.O. Box 4025, Golden, Colo. 80401). Loctite® 60-min cured adhesive produced by Henkel Corporation was used for bonding. The Spectra Shield® sheets were cut and placed inside an aluminum mold that has the shape of the SAPI shown in FIG. 7. The mold was heated inside a hot press at a temperature of between 1 and 10° C./min. It was held at a temperature between 120 and 150° C. for 30-min. The soaking time can be shorter or longer depending on the thickness of the backing structure. A first ballistic test was performed using a 0.30-06 AP M2 (NIJ level IV) 7.62×63 mm round, at 2800 psf fired at a right angle. A second test was performed using a 7.62 54R LPS ball at 2898 fps muzzle speed. Both shots were defeated, and the backface or rear surface deformation was very small.

EXAMPLE 11

We performed dropped weight tests to determine the behind-the-armor impact force (force transmitted through the ballistic shield). A Kistler dynamic load cell was fastened to a rigid table with the torque determined and given by the manufacturer. It was connected to a data acquisition and a computer for data collection. A state-of-the-art ballistic shield was placed on the Kistler dynamic load cell. The impactor of the drop weight tester has a semi-spherical shape with 0.25-inch radius. A dead weight of about 58-lb was put on top of the shaft (impactor) and dropped from a height of 1 foot. Impact force versus time at rear the surface of the ballistic shield was recorded by the Kistler load cell. The test was repeated using a SAPI prepared according to this invention. It was found that the behind-the-armor impact force of the preferred SAPI described herein was only ⅓ of that measured from a comparable state-of-the-art from Ceradyne. This capability offers the potential to significantly reduce impact force thus greatly reducing internal injury to the user when hit by a high energy projectile, for example a bullet from a high powered rifle.

EXAMPLE 12

We fabricated a fixture resembling a human body from clay as a support for the ballistic shield described above. A steel plug about 2-in in diameter was placed near the upper center of the fixture. A Kistler dynamic load cell was placed and fastened to this steel plug. Ballistic testing was performed using 7.62×63 mm AP M2 (NIJ Level IV) rounds at an average of 2800 fps (feet per second) from a distance of about 25-ft at a perpendicular angle. The SAPI was marked where the steel plug and load cell located underneath were located. The bullet was shot at the marked location. The impact force transmitted through the SAPI to the wearer was recorded by the data acquisition system connected to a computer. We also tested a state-of-the-art SAPI from Ceradyne. It was found that the behind-the-armor impact force of the state-of-the-art ballistic shield is 3 times higher that that of the SAPI made according to the present invention.

As the invention has been described, it will be apparent to those skilled in the art that the same may be varied in many ways without departing from the spirit and scope of the invention. Any and all such modifications are intended to be included within the scope of the appended claims.

What is claimed is:

1. A method for the fabrication of a multi-layer ballistic device including at least a supporting structure and a plate hard layer comprising: 1) wrapping at least one suitable plate in a thin plastic sheet; 2) fabricating a pair of molds from a blend of hydro-stone powder, water and fiber strands and pouring it over the plate using the plate as the shape of the cavity; 3) curing the mold thus formed at a temperature in excess of 21° C. for at least one hour; 4) placing multiple layers of ballistic resistant fabrics into the mold with the plate; 5) heating the mold containing said fabrics and said plates to a temperature of between 120 and 150° C. and holding such temperature for 15 to 60 minutes; and 6) cooling said mold to a temperature less than 27° C.

2. The method of claim 1 wherein said at least one suitable plate further comprises a ceramic plate.

3. The method of claim 1 wherein said at least one suitable plate further comprises a metallic plate.

4. A method for the fabrication of a multi-layer ballistic device including at least a supporting structure and a plate hard layer comprising: 1) wrapping at least one suitable plate in a thin plastic sheet; 2) fabricating a pair of molds from a blend of hydro-stone powder, water and fiber strands and pouring it over said plate using the plate as the shape of the cavity; 3) curing the mold thus formed at a temperature in excess of 21° C. for at least one hour; 4) placing multiple layers of ballistic resistant fabrics into the mold; 5) heating the mold containing said fabrics to a temperature of between 120 and 150° C. and holding such temperature for 15 to 60 minutes; 6) cooling the mold down to between 80° and 110° C.; 7) securing the plate and the multiple layers of ballistic resistant fabric together; and 8) cooling said plate and said fabric to a temperature less than 27° C.

5. The method of claim 4 wherein said at least one suitable plate further comprises a ceramic plate.

6. The method of claim 4 wherein said at least one suitable plate further comprises a metallic plate.

* * * * *